United States Patent [19]

Härtel et al.

[11] 4,420,439

[45] Dec. 13, 1983

[54] CONSTANT PRESSURE CARBURETTORS

[75] Inventors: Günter Härtel, Neuss; Armin Schürfeld; Anwar Abidin, both of Meerbusch, all of Fed. Rep. of Germany

[73] Assignee: Bösch & Pierburg System oHG, Neuss, Fed. Rep. of Germany

[21] Appl. No.: 343,974

[22] Filed: Jan. 29, 1982

[30] Foreign Application Priority Data

Feb. 10, 1981 [DE] Fed. Rep. of Germany ..... 3104559

[51] Int. Cl.[3] ..... F02M 15/04

[52] U.S. Cl. ..... 261/142; 261/145; 261/50 A; 261/121 B; 261/DIG. 74; 261/79 R; 123/545; 123/549

[58] Field of Search ..... 261/50 A, 142, 144, 261/145, DIG. 74, 121 B, 79 R; 123/545, 549

[56] References Cited

U.S. PATENT DOCUMENTS

| | | | |
|---|---|---|---|
| 1,238,787 | 9/1917 | Kidder | 261/50 A |
| 2,167,892 | 8/1939 | Kent et al. | 261/50 A |
| 3,351,327 | 11/1967 | Simonet et al. | 261/50 A |
| 3,498,279 | 3/1970 | Seeley, Jr. | 261/142 |
| 3,592,449 | 7/1971 | Elgohary | 261/50 A |
| 3,715,108 | 2/1973 | Denton | 261/50 A |
| 3,743,258 | 7/1973 | Florentine | 261/142 |
| 4,211,196 | 7/1980 | d'Orsay | 261/DIG. 74 |
| 4,302,407 | 11/1981 | Hartel et al. | 261/144 |
| 4,330,492 | 5/1982 | Mohr | 261/145 |
| 4,341,723 | 7/1982 | Hirosawa | 261/DIG. 74 |

FOREIGN PATENT DOCUMENTS

| | | | |
|---|---|---|---|
| 462333 | 3/1937 | United Kingdom | 261/50 A |
| 1191206 | 5/1970 | United Kingdom | 261/50 A |
| 2064657 | 6/1981 | United Kingdom | 261/142 |

*Primary Examiner*—Tim R. Miles

*Attorney, Agent, or Firm*—Toren, McGeady and Stanger

[57] ABSTRACT

A downdraught carburettor of the constant pressure type has a mixing chamber 2 with an operator-controlled throttle valve 3 at its downstream end and a choke valve 10, which is operated by a diaphragm box 20 in dependence upon the pressure in the mixing chamber 2, at its upstream end. Fuel is supplied to the mixing chamber from an annular duct 5 through ports 6 to the wall of the mixing chamber down which the fuel flows in the form of a thin film. The film is evaporated to form the mixture by a heating jacket 16 which surrounds the mixing chamber 2 and is heated by engine cooling water or exhaust gases. In order to prevent the film of fuel from being broken up before it has been heated and evaporated, which tends to happen owing to turbulence in the air stream caused by the choke valve 10, an inner tube 11 is provided. The choke valve 10 is situated in the upstream end of the inner tube 11 so that the fuel film is screened by the tube 11 from any turbulence caused by the valve 10. Air flow to draw fuel from the ports 6 and build up the film on the wall of the mixing chamber takes place through narrow annular ducts 12 between the tube 11 and the surrounding mixing chamber wall, these narrow ducts being uniformly spaced apart around the whole of the outside of the tube 11.

24 Claims, 4 Drawing Figures

CONSTANT PRESSURE CARBURETTORS

This invention relates to constant pressure carburettors, especially downdraught carburettors, for internal combustion engines, the carburettor comprising a mixing chamber surrounded by a tubular wall, an arbitrarily actuatable main throttle valve downstream of the mixing chamber, a choke valve, which is opened in dependence upon the magnitude of the air flow through the carburettor, upstream of the mixing chamber, and a fuel distributing device for supplying fuel on to the tubular wall in the mixing chamber, the distributing device having fuel metering means controlled by the choke valve.

Carburettors of this type, in which the fuel is supplied to the mixing chamber as a film on to the tubular wall, makes it possible to achieve a satisfactory evaporating mixture preparation and good transportation and distribution of the mixture. The evaporating mixture preparation is made even more effective by providing heating of the tubular wall of the mixing chamber. However satisfactory results can also be achieved without such heating. It is important that the film of fuel on the wall of the mixing chamber should not be broken up by air turbulence and transverse flows, such as may be caused by the choke valve. For this purpose we have already proposed to provide, between the choke valve and the fuel distributing device, a long flow stabilization zone, within which the vortices generated by the choke valve are broken down, so that generally quasi-laminar flow conditions are established downstream from the fuel distributing device in the mixing chamber. A disadvantage of this proposal is, however, that the provision of the flow stabilization zone leads to an increase in the overall size of the carburettor.

The aim of the present invention therefore is so to construct a constant pressure carburettor as initially described in such a way that a uniform, undisturbed film of fuel can be achieved on the tubular wall of the mixing chamber without it being necessary to provide a long flow stabilization zone downstream of the choke valve.

To this end, according to this invention we provide a downdraught constant pressure carburettor as initially described wherein an inner tube is provided substantially concentrically within the tubular wall; at least one duct is provided, which extends in the direction of air flow through the carburettor and leads into the mixing chamber from upstream of the mixing chamber, the duct or ducts having a flow cross-sectional area between the tubular wall and the inner tube, which is small compared with that of the inner tube; the or each duct is provided with a flow constricting profile at its inlet end for constricting the flow through the duct to produce a stable air flow through the duct; the fuel distributing device discharges the fuel into the or each duct downstream of the flow restricting profile; and the choke valve is provided in or at the upstream end of the inner tube.

The inner tube screens the choke valve and the air vortices generated by it completely from the fuel distributing device. The air vortices produced by the choke valve are largely broken down inside the inner tube, so that they no longer have a disturbing effect in the centre and radially outer regions of the mixing chamber. The flow constricting profile at the inlet of the at least one duct between the inner tube and the tubular wall makes it possible, in conjunction with the relatively small flow cross-section of the duct or ducts, for subatmospheric pressure conditions to predominate in the region of the fuel distributing device, these conditions being, as in the mixing chamber itself, substantially constant. As a consequence of the constrained flow of the air sucked in through the duct or ducts into the mixing chamber, the fuel reaching the tubular wall from the fuel distributing device is transported into and through the mixing chamber. In the case of a downdraught carburettor, this constrained flow is promoted by the effect of gravity. The overall height of a carburettor in accordance with the invention, in which the choke valve is situated inside the inner tube approximately at the level of the fuel distributing device, is small, and this leads to advantages in cost and ease of installation. Independently thereof, however, it is also possible to dispose the choke valve just upstream of the inner tube and of the fuel distributing device, since the air vortices generated by the choke valve are not able to penetrate into the relatively constricted duct or ducts leading to the fuel distributing device. Better protection from the vortices is however obtained when the choke valve is disposed inside the inner pipe.

An especially effective mixture-preparing evaporation of the film of fuel from the tubular wall can be achieved in a preferred construction in which the tubular wall surrounding the mixing chamber is formed, downstream of the fuel distributing device, as a heating wall. This heating wall is preferably a double heat exchanger wall through which engine cooling water or exhaust gas flows to provide the heating. It is also possible to heat the heating wall alternatively or additionally by electrical heating. With such a heating wall, it can be ensured that when the fuel mixture enters the inlet manifold of an engine downstream of the main throttle valve, virtually no fuel in the liquid phase still exists and thus wall wetting with liquid fuel is restricted essentially to the mixing chamber. In this mixing chamber, the heat supplied from the heating wall produces direct heating-up and evaporation of the film of fuel on the wall over a short distance, without the temperature of the intake mixture being unacceptably raised thereby. The air flowing through the inner tube is to all intents and purposes not heated with the result that the temperature of the intake fuel mixture is not unnecessarily raised. Owing to the rapid evaporation over a short distance of the film of fuel on the wall, no important errors in composition of the intake fuel mixture occur during non-steady running of the engine.

In one practical example of the carburettor in accordance with the invention, the choke valve is formed as a pivotal butterfly valve, which is mechanically connected with a diaphragm box which adjusts the choke valve as a function of the mixing chamber pressure. Such a choke valve is extremely simple and inexpensive and can be used in spite of the considerable turbulence which it causes without disadvantage, since the turbulence is limited to the interior of the inner tube.

Particularly when the choke valve is formed as a pivotal butterfly valve, it is preferred to provide in the mixing chamber a partition wall which extends in the direction of air flow through the chamber and substantially prevents transverse flows. The partition wall preferably extends approximately in the plane of pivot axes of choke valve and of the main throttle valve between these axes and adjoins the tubular wall at both edges. If the choke valve is a damper-type, pivotal valve, variable turbulence and pressure conditions obtain inside the mixing chamber on the two sides of the aforementioned plane, and these conditions can lead to transverse flows in the chamber. The partition wall prevents transverse flows from occuring and thus prevents disturbance of the fuel film resulting from the transverse flows.

In order to ensure that there is a stable air flow in the duct or ducts, it is sufficient to provide an external flow constricting profile, leading into the duct, at the inlet end of the inner tube. Consequently, the surrounding tubular wall can be continuous and remain as an existing carburettor of the type initially described. To improve flow conditions, it is also preferred to provide an internal flow constricting profile at the inlet end of the inner tube leading into the interior of this tube. In this manner, it is ensured by means of the two flow constricting profiles that no turbulence forms at the inlet edge of the inner tube.

It is in essence immaterial how the fuel is supplied to the duct or ducts and thence on to the tubular wall. In this connection, however, it is preferred to provide a fuel distributing device having an annular duct which is disposed in the tubular wall and leads into the duct or ducts via inlets distributed around the tubular wall. An approximately tangential auxiliary air duct and at least one fuel duct, which is provided with a fuel metering element associated with a fuel nozzle and actuated by the choke valve lead into the annular duct. Such a fuel distributing device makes it possible to produce within the annular duct a favourable fuel premixture which is then sucked via the inlets into the mixing chamber. The premixture is uniformly distributed around the annular duct and is sucked out in accordance with demand in dependence upon the number and arrangement of the inlets leading into the duct or ducts with the constriction. It is, however, also possible not to introduce the fuel into the constricted duct or ducts from the tubular wall, but from a portion of the inner tube.

According to a further preferred feature of the invention, two auxiliary air ducts are provided leading in the same sense tangentially into the annular duct and arranged diametrically opposite one another. These auxiliary air ducts make an especially effective distribution of the premixture in the annular duct possible and produce a favourable suction of the fuel into the annular duct.

In one practical example, the fuel duct is connected via a dip pipe to a float chamber and to a correction air by-pass, which is preferably controlled or regulated as a function of operating parameters of an engine to which the carburettor is fitted. This makes it possible for a variable mixture of fuel and correction air to be supplied to the fuel nozzle. As a consequence, the mixture ratio of air and fuel can be varied in a ratio of at least 3:1 and up to for example in the range of from 7:1 to 20:1, in order to satisfy all the required correction functions (e.g. adaptation to the characteristic field in the case of a hot and cold engine, transition enrichment, lambda regulation, and correction for altitude). Furthermore, the supply of correction air makes possible better transportation of the fuel to be sucked in. The controlling or regulating of the correction air by-pass may be effected as a function of various engine operating parameters, such as of the engine temperature, the inlet manifold air pressure, the throttle valve opening angle, the air temperature, the air pressure, the exhaust gas composition, the rate of change of inlet manifold pressure or choke valve opening angle.

In a further embodiment, a diffuser-like widening of the duct or ducts which maintains or promotes the fuel film on the tubular wall may be provided downstream of the fuel distributing device. This widening-out increases the residence time of the fuel on the heated wall and can prevent disturbance of the fuel film on the wall. The widening-out should be so formed that the film is maintained or indeed promoted and a sufficient residence time for the evaporation of the fuel is achieved. The widening-out can be attained by appropriate shaping of the tubular wall, of the inner tube or of both these components. In particular when the tubular wall is formed as a heating wall, it is preferred to use an inner tube which is in contact with the tubular wall at least at the level of the fuel distributing device. For this purpose the inner tube may be provided in the region of the inlets of the fuel distributing device externally with hollowed-out channels forming the ducts which are oriented in the main flow direction. Such channels, which are distributed around the outer periphery of the inner tube, have certain advantages compared with a single continuous annular duct, since the air flows through the channels are concentrated in the zones of the inlets of the fuel distributing device and thus rapid transporting of the fuel from the inlets by the air sweeping past into the region of the heated mixing chamber wall is produced. Furthermore, by having direct contact between tubular wall and the inner tube, an indirect heating of the inner wall is possible. This has the result that the evaporating mixture preparation is promoted. Furthermore, the peripheral distribution of the individual channels or ducts may be so arranged that, for given boundary conditions, such as the construction of an air filter fitted to the carburettor, inlet manifold construction, and the form of the engine, an optimum uniform distribution of the fuel to the individual cylinders of the engine may be achieved.

In general, it may be preferred to use hollowed-out channels uniformly distributed around the circumference of the inner tube in order to achieve a uniform fuel distribution. The fuel distribution provided or imposed by the fuel distributing device and the channels does not necessarily, however, have to be uniform around the circumference at the inlet end of the mixing chamber provided that it is ensured by the boundary conditions that uniformity in this respect is imposed downstream. It may also be made dependent upon the boundary conditions whether or not one inlet leads into each channel. These and also other features, such as the provision of the partition wall, may be advantageous in operation especially when the engine to which the carburettor is fitted is still cold and when a sufficient quantity of heat is not yet available for supply to the heating wall. Consequently, the size, number and distribution of the channels or other ducts and their association with the various inlets should be adapted in an optimum manner to the particular operating requirements for the carburettor.

In a further embodiment, the inner tube may be heated at its external peripheral surface. In this case, the inner tube may preferably be formed at its external circumferential surface as an electrical resistance element, for example a PTC element, which is electrically heated at least temporarily, for example until a sufficiently high mixing chamber heating wall temperature is attained. It is thereby possible, even during initial operation after a cold start, to ensure satisfactory mixture preparation. The heating of the inner tube can be shut off after adequate heating-up of the mixing chamber tubular wall has occurred.

In order to reduce the heat flow from the inner tube, when this is heated, to the air flowing through it, is is advantageous to provide thermal insulation between the outer and inner circumferential surfaces of the inner tube. For this purpose, a layer of thermally insulating material at the inner peripheral surface or a double-walled inner tube may be used.

In one practical form of embodiment there is provided, in a tube connecting the mixing chamber with the diaphragm box, a directionally dependent flow restrictor which has a greater restricting effect in the direction of opening of the choke valve and less restricting effect in the direction of closure of the choke valve. This makes possible rapid closure and retarded opening of the choke valve. Whereas during the rapid closure sweeping away of the fuel film on the tubular wall is prevented, the retarded opening enables a dynamic mixture enrichment for engine acceleration to be achieved. For these and other purposes it is furthermore possible to arrange for the optionally directionally dependent flow restriction to be controllable. Specific operating parameters may thereby be taken into account in the manner and magnitude of the flow throttling.

An example of a carburettor in accordance with the invention is illustrated in the accompanying drawings in which.

Figure 1:
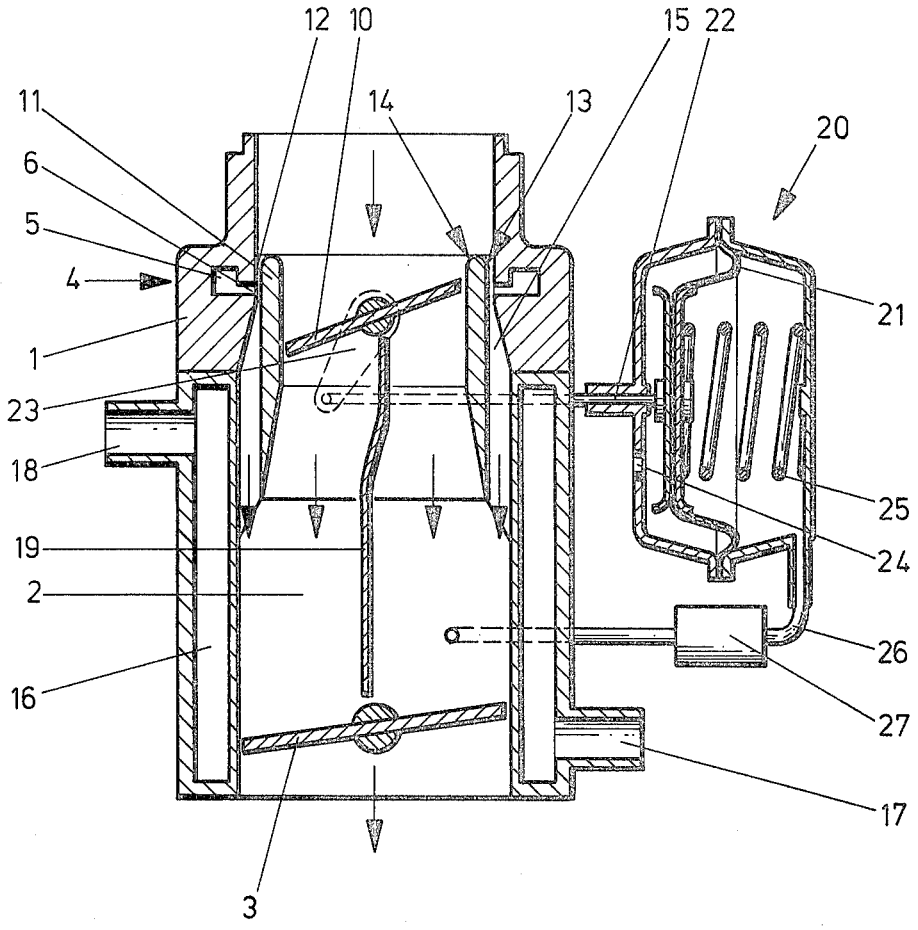
FIG. 1 is a diagrammatic longitudinal section through the carburettor and shows a diaphragm box which actuates a choke valve.

According to FIG. 1, a downdraught constant pressure carburettor has a tubular wall 1, which amongst other things surrounds a mixing chamber 2 upstream of a butterfly-type main throttle valve 3. Upstream of the mixing chamber 2 there is a fuel distributing device 4, comprising an annular duct 5, which is formed in the tubular wall 1 and leads via inlets 6, distributed around the periphery of the chamber 2 into channels or ducts 12, to be described in more detail below, likewise distributed around the periphery of the chamber 2.

Figure 3:
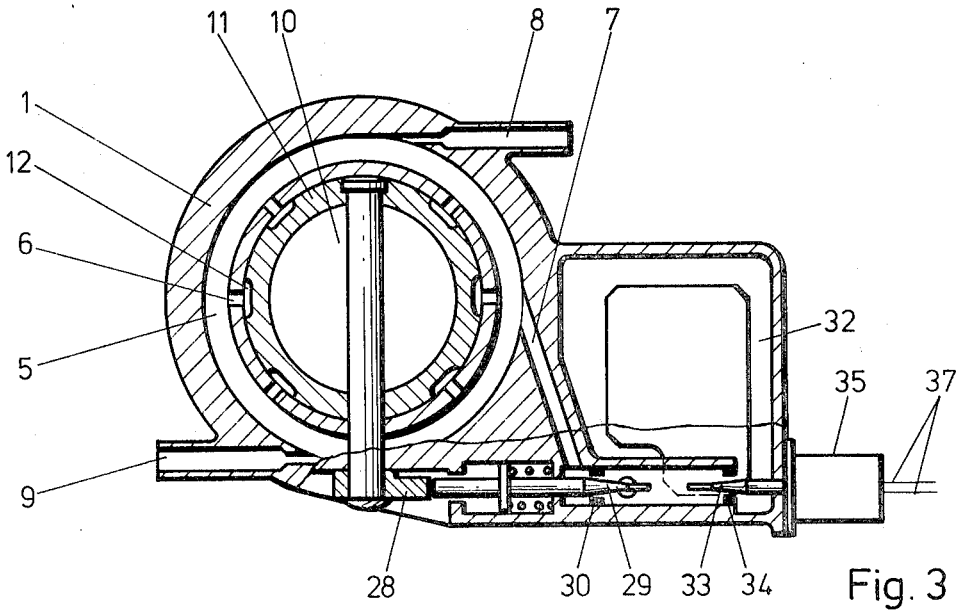
FIG. 3 is a section on the line III—III in FIG. 2.

From FIG. 3 it can be seen that a fuel duct 7 and two auxiliary air ducts 8, 9, which are diametrically opposite each other and are tangential in the same sense, lead approximately tangentially into the annular duct 5. In operation, a vacuum obtaining in the mixing chamber 2 passes, via the ducts 12 and the inlets 6, into the annular duct 5, so that fuel is sucked in through the fuel duct 7. By means of the auxiliary air ducts 8, 9 a uniformly distributed premixture is produced in the annular duct 5 and this subsequently flows through the inlets 6 into the ducts 12.

A choke valve 10, which is also formed as a simple pivotal damper or butterfly valve, is situated inside an inner tube 11, in the wall of which the choke valve 10, as shown in FIG. 3, is journalled. The choke valve 10 acts as an air valve for the main air flow path inside the inner tube 11. At the inlet edge of the inner tube 11 there are external and internal flow constricting profiles 13 and 14, which ensure that no turbulence occurs at the edge face and stable flow is maintained through the ducts 12.

In the present example, each inlet 6 of the fuel distribution device 4, as shown in FIG. 3, leads to a duct or channel 12, which is formed in the periphery of the inner tube 11, which is in contact in the inlet region with the tubular wall. The ducts 12 are oriented in the direction of main air flow through the carburettor. It is alternatively possible, instead of providing a number of separate ducts 12 distributed around the mixing chamber, to provide a single continuous, annular duct. The inlets 6 lead into the ducts 12 sufficiently far downstream of the flow constricting profile 13 to ensure that a constant suction pressure, largely representing the substantially constant vacuum in the mixing chamber 2, becomes established at the inlets 6. Downstream of the inlets 6, the ducts or channels 12 may have, for example, a diffuser-like widening-out 15, in order to avoid the production of vortices and disturbances of the fuel film on the tubular wall and to achieve the required residence time of the film on the wall of the mixing chamber.

Air vortices formed as a consequence of the choke valve 10 build up at least mainly inside the inner tube 11, so that they cannot disturb the film of fuel on the wall of the mixing chamber 2. Furthermore, the air vortices are completely screened from the inlets 6 of the fuel distribution device 4, and substantially stable flow conditions obtain in the ducts or channels 12. The fuel is rapidly entrained by the air stream 5 in the ducts or channels 12 and is conducted to a heated wall of the mixing chamber 2.

In the present example, a heated wall 16 which surrounds the mixing chamber 2, is formed as a heat exchanger double wall having an inlet 17 and an outlet 18 to enable engine cooling water to flow through it. The heated wall extends approximately from the main throttle valve 3 to a position a little downstream of the fuel distributing device 4, so that the fuel reaching the tubular wall which is moved downwards under the influence of gravity and of the downward air flow past it, has a sufficient residence time for the evaporation to take place from the heated wall. This is particularly so because air vortices produced by the choke valve 10 are limited substantially to the interior of the inner tube 11 and, as a consequence of the provision of a partition wall 19 inside the mixing chamber 2, no disturbing transverse flows can occur. The partition wall 19 lies, in the present example, in the plane of the pivot axes of the main throttle valve 3 and of the choke valve 10 and extends between these axes. In a manner not illustrated, the two longitudinal edges of the partition wall 19 touch the tubular wall 1 or the heating wall 16, so that no flow takes place between the two halves of the mixing chamber on the two sides of the partition wall 19 as a result of pressure differences which may be caused by the pivotal choke valve 10.

As shown in FIG. 1, a diaphragm box 20 contains a diaphragm 21, which is pivotally connected by a rod 22 to a lever 23 which is in turn connected to the choke valve 10. One chamber of the diaphragm box has a vent 24 and a spring 25 is disposed in the working chamber (not referenced) of the diaphragm box 20. The spring biasses the diaphragm 21 and thus the choke valve 10 in the closure direction. The working chamber of the diaphragm box 20 is connected by a vacuum line 26 and a flow restrictor 27 incorporated therein to the mixing chamber 2. The flow restrictor 27 can be directionally dependent in operation in such a manner that the flow restriction in the direction of closure of the choke valve 10 is less and in the direction of opening is greater, in order thereby to provide acceleration mixture enrichment. Instead, or additionally thereto, the flow restrictor 27 may also be controllable as a function of any desired operating parameters of the engine on which the carburettor is used.

Figure 2:
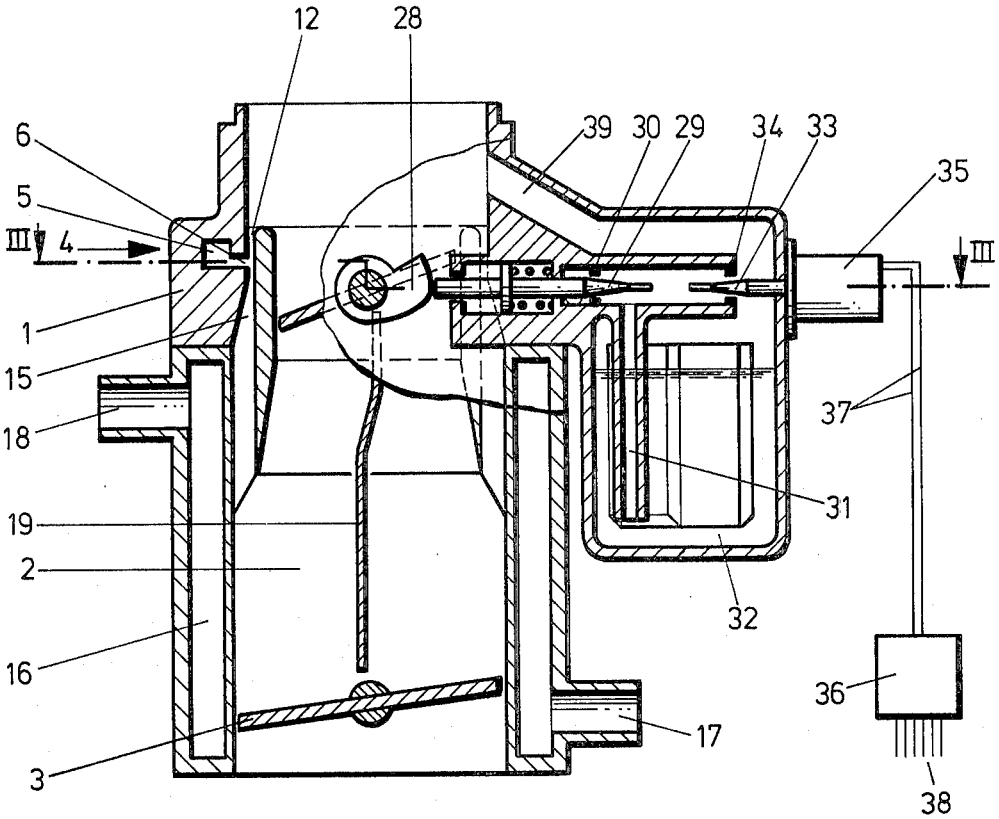
FIG. 2 is another longitudinal section of the carburettor in a plane which contains a float chamber and components associated therewith.

In FIG. 2, components corresponding to FIG. 1 have the same reference numerals. From FIG. 2 and from the other section of FIG. 3 it can furthermore be seen that a cam disc 28 is fixed to the pivot spindle of the choke valve 10 and this cam disc ensures a movement control of a fuel metering element 29 which is dependent on the position of the choke valve. This element is pressed at the rear by a spring, not referenced, against the cam disc 28 and carries at its free end a metering needle which, depending upon the position of the metering element 29, extends to a greater or lesser extent into a fuel nozzle 30 in the interior of the fuel duct 7. The fuel may be sucked via a dip pipe 31 from a float chamber 32 and is metered in dependence on the free cross-section at the fuel nozzle 30.

The fuel is sucked out of the dip pipe 31 initially into a pipe, not referenced, upstream if the fuel nozzle 30, into which furthermore correction or auxiliary air can be sucked through an air nozzle 34. An air metering element 33 penetrates to a greater or lesser extent into the air nozzle 34. A by-pass 39, branching from the carburettor air inlet, is connected to the inlet of the air nozzle 34 and to the float chamber 32. The setting of the air metering element 33 is effected by means of an electrical actuator 35, which is connected via conductors 37 to an electronic control 36. The control 36 has inputs 38, through which the setting of the correction or auxiliary air supply can be carried out as a function of various operating parameters, such as the engine temperature, inlet manifold pressure, throttle valve opening angle, air temperature, air pressure, exhaust gas composition, rate of change of inlet manifold pressure or choke valve opening angle, or a combination of these operating parameters. Apart from the change to the mixture ratio of air and fuel, the correction or auxiliary air can be utilized for improving the transportation of the fuel. Preferably, the mixture ratio of air and fuel can be varied at least in a ratio of 3:1. In this way the requirements for a variation in the mixture ratio when the engine is not yet hot in steady of non-steady operation and in corrections to the characteristic field or when one control circuit is closed (for example lambda=1 control) can be fully satisfied.

For a cold start, an additional increase in the flow cross-section between the fuel nozzle 30 and the fuel metering element 29 is effected by a separate intervention or by opening a by-pass duct to the fuel nozzle 30, for the duration of the starting operation in a manner not illustrated.

The total flow cross-section of the ducts or channels 12 is small compared with the flow cross-section of the inner tube 11. When air is drawn in by the internal combustion engine via the main throttle valve 3, a vacuum develops in the mixing chamber 2. This vacuum acts, via the vacuum line 26 upon the diaphragm box 20, in such a manner that its diaphragm 21 is moved in opposition to the force of the spring 25 in a direction to open the choke valve 10. Depending upon the air throughput, the choke valve 10 is opened sufficiently far on each occasion for a force equilibrium to become established and for a substantially constant vacuum to be maintained in the mixing chamber 2. The flow cross-section of the ducts or channels 12 is preferably such that the choke valve 10 does not reach a fully closed rest position even with a low air demand in idling operation. It is thereby ensured that, in the entire working range of the carburettor, a sub-atmospheric pressure exists in the mixing chamber 2, this pressure being determined by the force of the spring 25. The flow restrictor 27 damps the movements of the choke valve 10 in non-steady operation of the engine or during strong suction pressure fluctuations and can be directionally dependent and/or be controllable in the aforementioned manner for the purpose described.

Figure 4:
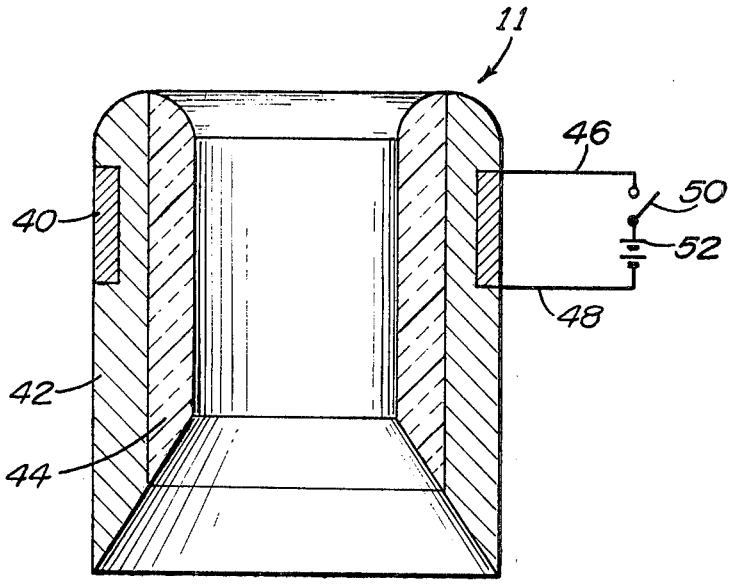
FIG. 4 is an enlarged sectional view of an inner tube incorporating heating means.

The illustrated example can be varied in many respects. For example it is not necessary to suck the fuel via a dip pipe out of a float chamber. Instead of a float chamber, the fuel may flow from a system having pressure regulation, which is preferably arranged to act at a fuel pressure higher than atmospheric pressure (i.e. a pressure carburettor). Also, a mechanical conversion of the setting of the choke valve 10 into the setting of the fuel metering element 29 is not necessary, since for this purpose, for example an electrical conversion can be used. Further, the addition of the correction air may be effected at a different position, for example via an annular chamber of the fuel nozzle 30, constructed specifically for this purpose. By appropriate selection of the cam form of the cam disc 28 and of the needle shape in the zone of the fuel nozzle 30, any desired variation of the fuel nozzle cross-section and thus of the suction mixture to the air flow rate can be obtained. A variation of the mixture ratio of air and fuel is possible, for example, in a ratio from 7:1 to 21:1, with the chosen dependence upon the air flow rate, by the adjustable supply of correction or auxiliary air. Furthermore, as shown in FIG. 4 the inner tube 11 can be externally electrically heated using an electrical resistance element 40, for example by a PTC element, located in its external circumferential surface of the inner tube, until a sufficiently high temperature of the mixing chamber tubular wall is reached, in order to ensure satisfactory preparation of the mixture during cold starting. In this connection, the heat flow from the outside to the inside of the inner tube should preferably be largely prevented by thermal insulation, note the inner tube 11 has a heat conducting outer section 42 and a heat insulating inner section 44 in order that unacceptable heating up of the air flowing through the inner tube be avoided. In all variants of the example, however, it is important for the air vortices produced by the choke valve to be substantially limited to the interior of the inner tube and to be kept away from the fuel distributing device and the heated wall, in order that no appreciable disturbance of the fuel film on the tubular wall shall take place and the heat at the mixing chamber wall shall serve only for evaporating the fuel film and shall not unnecessarily raise the temperature of the intake mixture. For heating the electrical resistance element 40 it is connected by electrical connection lines 46, 48 to the thermally controlled switch 50. The switch is closed only in the cold state of the engine. A supply battery 52, such as a motor vehicle battery, is connected to the element 40 via the connection lines 46, 48 and the switch 50.

We claim:

1. A constant pressure carburettor for an internal combustion engine, said carburettor comprising a mixing chamber, a tubular wall surrounding said mixing chamber, a selectively actuatable main throttle valve located downstream of said mixing chamber, an inner tube located within and substantially concentrically with said tubular wall, a choke valve located adjacent the upstream end of said inner tube upstream of said mixing chamber, said choke valve being openable in dependence upon the magnitude of the air flow through said caraburettor, at least one duct located between said tubular wall and said inner tube and said duct extending in the direction of air flow through said carburettor and leading into said mixing chamber from a location upstream of said mixing chamber, said duct has a flow cross-sectional area which is small compared to that of said inner tube, said at least one duct is provided with a flow constricting profile at the inlet end thereof for constricting the flow through said duct for producing a stable air flow through said duct, and a fuel distributing device for discharging fuel into said at least one duct downstream of said flow restricting profile, said distributing device including fuel metering means controlled by said choke valve, wherein the improvement comprises a partition wall located within said mixing chamber, said partition wall extending in the direction of air flow through said mixing chamber and substantially preventing air flow transverse of the direction of said air flow through said mixing chamber, and said fuel distributing device arranged for supplying fuel onto said tubular wall.

2. A carburettor as claimed in claim 1, said carburettor being of the downdraught type.

3. A carburettor as claimed in claim 1, further comprising heating means in said tubular wall downstream of said fuel distributing means.

4. A carburettor as claimed in claim 3, in which said heating means comprises a heat exchanger double wall and means for supplying engine cooling water or engine exhaust gas to said double wall.

5. A carburettor as claimed in claim 1, in which said choke valve comprises a pivotal butterfly valve, and said carburettor further comprising a diaphragm box, means connecting said diaphragm box to said mixing chamber and means mechanically connecting said diaphragm box to said butterfly valve, whereby the opening of said butterfly valve is adjusted in dependence upon the pressure in said mixing chamber.

6. A carburettor as claimed in claim 5, further comprising a line connecting said mixing chamber to said diaphragm box, and a directionally dependent flow restrictor in said line, said restrictor providing a greater restriction to flow through said line which causes opening of said choke valve and less restriction to flow through said line in a direction which causes closing of said choke valve.

7. A carburettor as claimed in claim 5, further comprising a line connecting said mixing chamber to said diaphragm box, flow restrictor means in said line and control means for varying the restriction to flow caused by said restrictor.

8. A carburettor as claimed in claim 1, in which said flow constricting profile is provided on an outer edge of the upstream end of said inner tube and said profile leads into said at least one duct.

9. A carburettor as claimed in claim 8, further comprising means defining a further flow constricting profile on the inner edge of the upstream end of said inner tube, said further flow constricting profile leading into the interior of said inner tube.

10. A carburettor as claimed in claim 1, further comprising means defining a diffuser-like divergence in said at least one duct downstream of said fuel distributing means, said divergence being arranged to promote the formation of a film of fuel on said tubular wall in said mixing chamber.

11. A carburettor as claimed in claim 1, further comprising means for heating said external peripheral surface of said inner tube.

12. In a constant pressure carburettor for an internal combustion engine, said carburettor comprising a tubular wall defining a mixing chamber having an upstream end and a downstream end, a main throttle valve at said downstream end of said mixing chamber, a choke valve at said upstream end of said mixing chamber, means for opening and closing said choke valve in dependence upon the magnitude of air flow through said mixing chamber, fuel distributing means for supplying fuel on to said tubular wall in said mixing chamber, fuel metering means for controlling the supply of said fuel and means controlling said metering means in dependence upon the opening of said choke valve, an inner tube, means mounting said inner tube substantially concentrically within said tubular wall, means defining at least one duct between said tubular wall and said inner wall, said at least one duct extending in the direction of air flow through said mixing chamber and leading to said mixing chamber from a position upstream of said mixing chamber, said at least one duct having a flow cross-sectional area which is small compared with that of said inner tube, means defining a flow constricting profile at the upstream end of said at least one duct for constricting the flow through said at least one duct to produce a stable air flow therein, said fuel distributing means including means for discharging said fuel into said at least one duct downstream of said flow restricting profile, said choke valve being located in or adjacent the upstream end of said inner tube, said choke valve comprises a displaceable valve, said carburettor further comprising a diaphragm box, means connecting said diaphragm box to said mixing chamber, means mechanically connecting said diaphragm box to said choke valve, whereby the opening of said choke valve is adjusted in dependence upon the pressure in said mixing chamber, wherein the improvement comprises a partition wall in said mixing chamber, said partition wall extending in a direction of air flow through said mixing chamber and being operative substantially to prevent air flow transverse to said direction of air flow through said mixing chamber.

13. A carburettor as claimed in claim 12, in which said choke valve and said throttle valve include pivot axes lying in a plane and in which said partition wall lies substantially in said plane and extends between said axes, said partition wall including side edges adjoining said tubular wall which defines said mixing chamber.

14. In a constant pressure carburettor for an internal combustion engine, said carburettor comprising a tubular wall defining a mixing chamber having an upstream end and a downstream end, a main throttle valve at said downstream end of said mixing chamber, a choke valve at said upstream end of said mixing chamber, means for opening and closing said choke valve in dependence upon the magnitude of air flow through said mixing chamber, fuel distributing means for supplying fuel on to said tubular wall in said mixing chamber, fuel metering means for controlling the supply of fuel, means controlling said metering means in dependence upon the opening of said choke valve, an inner tube, means mounting said inner tube substantially concentrically within said tubular wall, means defining at least one duct between said tubular wall and said inner tube, said at least one duct extending in the direction of air flow through said mixing chamber and leading to said mixing chamber from a position upstream of said mixing chamber, said at least one duct having a flow cross-sectional area which is small compared with that of said inner tube, means defining a flow constricting profile at the upstream end of said at least one duct for constricting the flow through said at least one duct to produce a stable air flow therein, said fuel distributing means including means for discharging said fuel into said at least one duct downstream of said flow restricting profile, and said choke valve being located in or adjacent the upstream end of said inner tube, wherein the improvement comprises that said fuel distributing means includes means defining an annular duct in said tubular wall, means defining inlets spaced around said tubular wall and communicating said annular duct and said at least one duct, and said carburettor further comprising means defining at least one auxiliary air duct and at least one fuel duct, said at least one auxiliary air duct and said at least one fuel duct leading substantially tangengtially into said annular duct, and said fuel metering means including a fuel nozzle in said fuel duct, a fuel metering element co-operating with said fuel nozzle and means connected to said choke valve for moving said fuel metering element relative to said fuel nozzle.

15. A carburettor as claimed in claim 14, in which there are two of said auxiliary air ducts, said two auxiliary air ducts leading tangentially in the same sense into said annular duct in positions substantially diametrically opposite each other.

16. A carburettor as claimed in claim 14, further comprising a fuel floatchamber, a dip pipe dipping into said floatchamber, and a correction air by-pass, said fuel duct being connected between said dip pipe and said correction air by-pass.

17. A carburettor as claimed in claim 16, further comprising means for controlling the air flow through said correction air by-pass in dependence upon operating parameters of an engine to which said carburettor is, in use, fitted.

18. In a constant pressure carburettor for an internal combustion engine, said carburettor comprising a tubular wall defining a mixing chamber having an upstream end and a downstream end, a main throttle valve at said downstream end of said mixing chamber, a choke valve at said upstream end of said mixing chamber, means for opening and closing said choke valve in dependence upon the magnitude of air flow through said mixing chamber, fuel distributing means for supplying fuel on to said tubular wall in said mixing chamber, fuel metering means for controlling the supply of said fuel and means controlling said metering means in dependence upon the opening of said choke valve, an inner tube, means mounting said inner tube substantially concentrically within said tubular wall, means defining at least one duct between said tubular wall and said inner tube, said at least one duct extending in the direction of air flow through said mixing chamber and leading to said mixing chamber from a position upstream of said mixing chamber, said at least one duct having a flow cross-sectional area which is small compared to that of said inner tube, means defining a flow constricting profile at the upstream end of said at least one duct for constricting the flow through said at least one duct to produce a stable air flow therein, said fuel distributing means including means for discharging said fuel into said at least one duct downstream of said flow restricting profile, and said choke valve being located in or adjacent the upstream end of said inner tube, wherein the improvement comprises that said inner tube has a surface which, at least adjacent said fuel distributing means, is in contact with said tubular wall, and said inner tube has an external surface formed adjacent said fuel distributing means with channels which form the upstream end of said at least one duct.

19. A carburettor as claimed in claim 18, in which said channels are uniformly spaced around said external surface of said inner tube.

20. In a constant pressure carburettor for an internal combustion engine, said carburettor comprising a tubular wall defining a mixing chamber having an upstream end and a downstream end, a main throttle valve at said downstream end of said mixing chamber, a choke valve at said upstream end of said mixing chamber, means for opening and closing said choke valve in dependence upon the magnitude of air flow through said mixing chamber, fuel distributing means for supplying fuel on to said tubular wall in said mixing chamber, fuel metering means for controlling the supply of said fuel and means controlling said metering means in dependence upon the opening of said choke valve, an inner tube, means mounting said inner tube substantially concentrically within said tubular wall, means defining at least one duct between said tubular wall and said inner tube, said at least one duct extending in the direction of air flow through said mixing chamber and leading to said mixing chamber from a position upstream of said mixing chamber, said at least one duct having a flow cross-sectional area which is small compared with that of said inner tube, means defining a flow constricting profile at the upstream end of said at least one duct for constricting the flow through said at least one duct to produce a stable air flow therein, said fuel distributing means including means for discharging said fuel into said at least one duct downstream of said flow restricting profile, and said choke valve being located in or adjacent the upstream end of said inner tube, means for heating said external peripheral surface of said inner tube, wherein the improvement comprises that said heating means includes an electrical resistance element on said external peripheral surface and means for heating said element during cold starting of an engine to which said carburettor is, in use, fitted.

21. A carburettor as claimed in claim 20, in which said element is a PTC element.

22. A carburettor as claimed in claim 20, further comprising a layer of thermal insulation on the inner peripheral surface of said inner tube.

23. A carburettor as claimed in claim 11 or 20, further comprising thermal insulation between inner and said outer peripheral surfaces of said inner tube.

24. A carburettor as claimed in claim 23, in which said inner tube is double-walled with a space between said double wall, said space forming said thermal insulation.

* * * * *